US005902661A

United States Patent [19]

Oster

[11] Patent Number: 5,902,661

[45] Date of Patent: May 11, 1999

[54] SPORTS TOWEL

[76] Inventor: David M. Oster, 16974 Hanover La., Eden Prairie, Minn. 55374

[21] Appl. No.: 08/835,524

[22] Filed: Apr. 8, 1997

Related U.S. Application Data

[60] Provisional application No. 60/015,426, Apr. 15, 1996.

[51] Int. Cl.[6] ..... A47K 10/02

[52] U.S. Cl. ..... 428/82; 428/85; 442/320

[58] Field of Search ..... 428/82, 85, 99, 428/100, 102; 442/320

[56] References Cited

U.S. PATENT DOCUMENTS

| | | | |
|---|---|---|---|
| D. 317,693 | 6/1991 | Jencks et al. | D6/608 |
| D. 330,140 | 10/1992 | Lerner | D6/608 |
| D. 360,797 | 8/1995 | Evans | D6/608 |
| 2,754,532 | 7/1956 | Kanehl et al. | 2/48 X |
| 4,516,616 | 5/1985 | Fesler | 150/154 |
| 4,912,800 | 4/1990 | Zeltner | 15/114 |
| 5,060,943 | 10/1991 | Stoffo | 206/210 X |
| 5,075,918 | 12/1991 | Zeltner et al. | 15/114 X |
| 5,147,703 | 9/1992 | Provost et al. | 428/82 |
| 5,331,705 | 7/1994 | Melov | 15/118 |
| 5,407,723 | 4/1995 | Curtin | 428/82 X |
| 5,443,880 | 8/1995 | Wike | 428/85 X |
| 5,444,890 | 8/1995 | Higginson | 15/214 |

*Primary Examiner*—Henry F. Epstein
*Attorney, Agent, or Firm*—Hoffman, Wasson & Gitler

[57] ABSTRACT

A sports towel with diverse abrasive surfaces, multiple means for connection to a target element, interior polishing pockets and exterior accessory pockets. A first embodiment includes a piece of material having a first, pile-like textured surface and a second, felt-like textured surface. A second embodiment provides a second piece of material mounted on the first piece of material along the peripheral edges thereof, defining a pocket. A third embodiment provides a third piece of material mounted on the assembly of the first and second pieces of material, along only a portion of the periphery of the third piece of material, defining a pocket.

17 Claims, 9 Drawing Sheets

SPORTS TOWEL

This application claims benefit of Provisional application Ser. No. 60/015,426 filed Apr. 15, 1996.

BACKGROUND OF THE INVENTION

1. Field of Invention

The present invention relates to towels adapted for sporting events, specifically golf.

2. Description of the Prior Art

Sport towels are well known in the art. Typically, sport towels comprise a two-sided, absorbent, textured material for wiping one's hands or pieces of equipment associated with a sport. Often, these towels are attached to various target elements, such as the user's belt or equipment container, such as a golf bag.

The patent literature is replete with many towel inventions. Some towel inventions include diverse surfaces for providing different gradations of abrasion. Some towel inventions provide pockets for receiving hands or pieces of equipment. However, no invention encompasses all of these features plus the added feature of a storage pocket for receiving items such as glasses or score cards and the like. For example, in U.S. Pat. No. 2,754,532, issued Jul. 17, 1956, to L. H. Kanehl et al., a sports towel is shown having means for attachment to a belt. The attachment means includes a snap having a first part at the distal end of a strap and a second part located at some point down the strap which engages with the first part and secures a loop about a belt.

U.S. Pat. No. 5,147,703, issued Sep. 15, 1992, to J. Provost et al., describes a golf towel set including a generally teardrop-shaped towel with a belt clip mounted thereon. The invention may include an ancillary towel having a similar, smaller shape mounted on the towel as well. Both the larger and smaller towels are formed by folding the two outer edges toward the center of the back towel, similar to that of a conventional four-in-hand towel.

U.S. Pat. No. 5,331,705, issued Jul. 26, 1994, to M. Melov, describes a cleaning aid comprising a cloth towel having a fiber scouring pad and a cleaning cloth stitched over part of the cloth. The invention includes a two-piece snap assembly mounted directly on a towel itself such that the corner of the towel may be doubled onto itself and secured about a belt.

U.S. Design Pat. No. Des. 317,693, issued Jun. 25, 1991, to A. C. Jencks et al., shows a golf towel having a generally teardrop shape. As with the Provost et al. patent described above, the towel is formed by folding the outer edges in toward the center of the back of the towel. A hook/snap fastening means is mounted on the top of the towel.

U.S. Design Pat. No. Des. 330,140, issued Oct. 13, 1992, to H. Lerner, shows a towel having an inside pocket to wipe off golf clubs and balls. The device has two sheets of toweling which appear to be stitched about three edges to define an interior volume. The two stitched corners farthest from the opening are folded toward each other and retained together by a ring clip.

U.S. Design Pat. No. Des. 360,797, issued Aug. 1, 1995, to M. S. Evans, shows a combined towel and mesh bag. The device appears to include a towel section connected to a mesh section. The mesh section appears to define some sort of interior pocket. The means for and the extent of the definition of the mesh bag are unclear.

U.S. Pat. No. 4,516,616, issued May 14, 1995, to E. F. Fesler, describes a portable towel accessory. The device includes a cover which hangs freely from the carrying means and a towel which hangs freely from a connector means within the cover. The key carrying means include a chain interconnecting loops, or loops extending from the cover.

U.S. Pat. No. 5,444,890, issued Aug. 29, 1995, to T. B. Higginson, describes lens cleaning devices. The device includes a generally hourglass-shaped towel which may be folded about an axis transverse to its longitudinal axis. A second piece may be adapted and mounted to fit around the locally folded area. An attachment strap with an attached hook clasp are mounted on the invention for easy attachment to a belt or golf bag.

U.S. Pat. No. 5,075,918, issued Dec. 31, 1991, to B. Zeltner et al., describes a combination cleaning towel and carrying case with construction method therefor. The body of the device is made from a folded towel stitched back to back, defining an interior pocket. A second towel device is stitched about an upper portion and hangs freely along the outside of the body of the device. A brush may be attached to a lower front portion thereof. The device is connected to a golf bag by means of a loop.

U.S. Pat. No. 4,912,800, issued Apr. 3, 1990, to B. Zeltner, describes a cleaning device for golfers and construction method therefor. The device includes a conventional towel having elements stitched thereto having different textural qualities. The device may be attached to a golf bag by means of a loop.

U.S. Pat. No. 5,060,943, issued Oct. 29, 1991, to L. M. Stoffo, describes a gripping aid. The device includes a fabric member impregnated with non-slip material attached, in layered fashion, to a terrycloth towel arranged so as to protect the impregnated layer. The device includes an attached patch of hook-and-loop material to facilitate its attachment to a belt or golf bag. The device also may include a loop for performing the same function.

Clearly the above illustrates the need for a sports towel possessing diverse abrasive surfaces, internal pockets for receiving equipment, external pockets for receiving accessories and a fastener for attaching the present sports towel to a target element.

None of the above references, singly or in combination, teach or suggest the present invention.

BRIEF SUMMARY OF THE INVENTION

The present invention overcomes the limitations of the prior art by providing a sports towel with diverse abrasive surfaces, multiple means for connection to a target element, interior polishing pockets and exterior accessory pockets. A first embodiment of the invention includes a piece of material having a first surface and a second surface. The first surface has a pile-like texture and the second surface has a felt-like texture. A second embodiment of the invention provides a second piece of material mounted on the first piece of material along the respective peripheral edges of the first and second pieces of material. A pocket is formed by the first and second pieces of material and the seam therebetween. A third embodiment of the invention provides a third piece of material mounted on the assembly of the first and second pieces of material, along only a portion of the periphery of the third piece of material. The third piece of material forms a mesh pocket for holding accessories.

According, a first object of the present invention is to provide a sports towel having multiple surfaces of differing abrasive levels.

A second object of the invention is to provide a sports towel with an internal pocket for cleaning or polishing sports equipment.

A third object of the invention is to provide a sports towel having an external pocket for receiving accessories.

A fourth object of the invention is to provide a sports towel having a wide variety of mechanisms for attaching the towel to a target element, such as a belt.

A fifth object of the invention is to provide improved elements and arrangements thereof, in an apparatus that is inexpensive, dependable and effective in accomplishing its intended purposes.

BRIEF DESCRIPTION OF THE DRAWINGS

Similar reference numerals denote corresponding features of the invention consistently throughout the attached drawings.

DETAILED DESCRIPTION OF THE INVENTION

Figure 1:
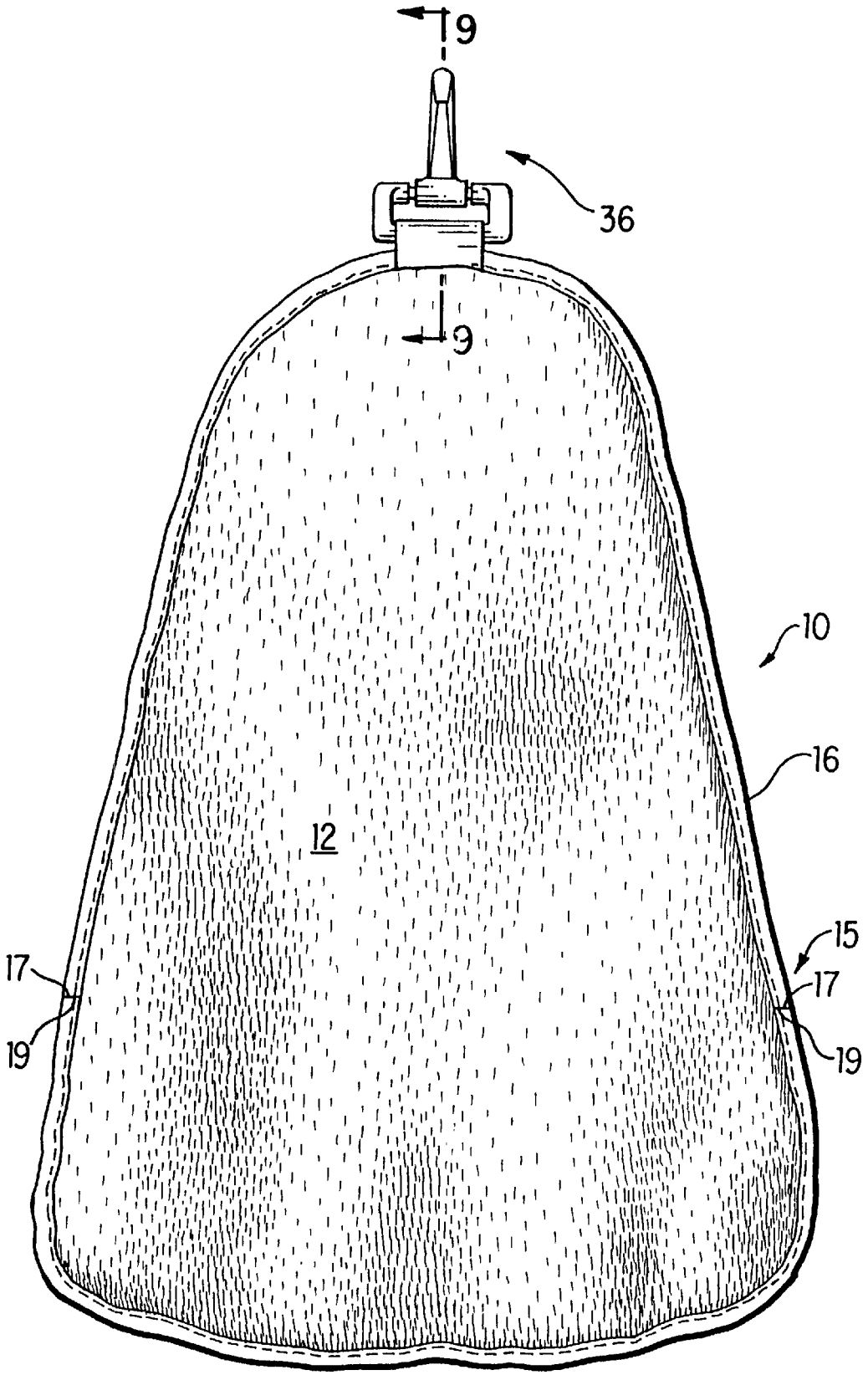
FIG. 1 is a plan view of a first embodiment of the invention.

Referring to FIG. 1, the invention is a generally tear-dropped-shaped towel assembly. A first embodiment of the invention includes a first piece 10 of material. The first piece of material has a first surface 12 and a second surface (not shown) . The first surface provide a pile-like texture to provide a course cleaning cloth. The first piece of material may be constructed from a brushed acrylic pile. An alternative embodiment of the invention provides a first piece 10 composed of a nylon mesh material, significantly more abrasive than pile-like material, to aid in scrubbing stubbornly soiled articles, such as golf clubs.

The first piece of material 10 has a second surface (not shown) having a felt-like texture. The felt-like textured material provides a fine polishing surface for articles such as eyeglasses. Preferably, the material is constructed from a polypropylene knit.

The invention may include indicia affixed to the first piece 10. The indicia may be embroidered directly onto the first piece 10 or onto a label (not shown). The label (not shown) may be secured to the first piece 10 by conventional means, such as stitching, glue and the like. The indicia may identify the number or brand name of the towel, such as "CLEAN SWING."

Rather than relying on a single piece of material having one surface with a course texture and another surface with a fine texture, a second embodiment of the invention provides a second piece of material (not shown) mounted on the first piece 10. The second piece (not shown) should complement the shape of the first piece 10. The material of the second piece (not shown) may be selected from any felt-like material. Preferably, the material is polypropylene knit. An alternative embodiment of the invention provides a second piece (not shown) of a nylon mesh material as described above. Thus the alternative embodiment provides coarse and coarser cleaning surfaces.

The second piece (not shown) may be mounted on the first piece 10 by conventional means, such as stitching and/or gluing. Although the first piece 10 and second piece may be mounted to one another entirely along their respective mating surfaces, preferably, they are stitched about their respective peripheral edges with piping 16. The piping 16 may be selected from any durable material. Preferably, the piping 16 material is nylon knit.

Alternatively, rather than being connected entirely along their respective peripheral edges, another embodiment of the invention provides that the first and second piece may be connected to each other along a portion of their respective peripheral edges. Referring again to FIG. 1, the numeral 15 generally designates the peripheral edge of the first piece. For the sake of discussion, the second piece (not shown) is presumed to define a surface coextensive with the surface 12 of the first piece. Accordingly, the second piece has a peripheral edge coextensive with the peripheral edge 15 of the first piece 10. Further for the sake of discussion, the peripheral edge 15 is divided into two portions, a first portion 17 and a second portion 19. In this embodiment, the first portion of the peripheral edge of the first piece is joined with the first portion of the peripheral edge of the second piece, defining a seam. The remaining second portion of the peripheral edge of the first piece and the second portion of the peripheral edge of the second piece define an aperture for a pocket which is defined by the inner surfaces of the first piece, second piece and seam.

Figure 2:
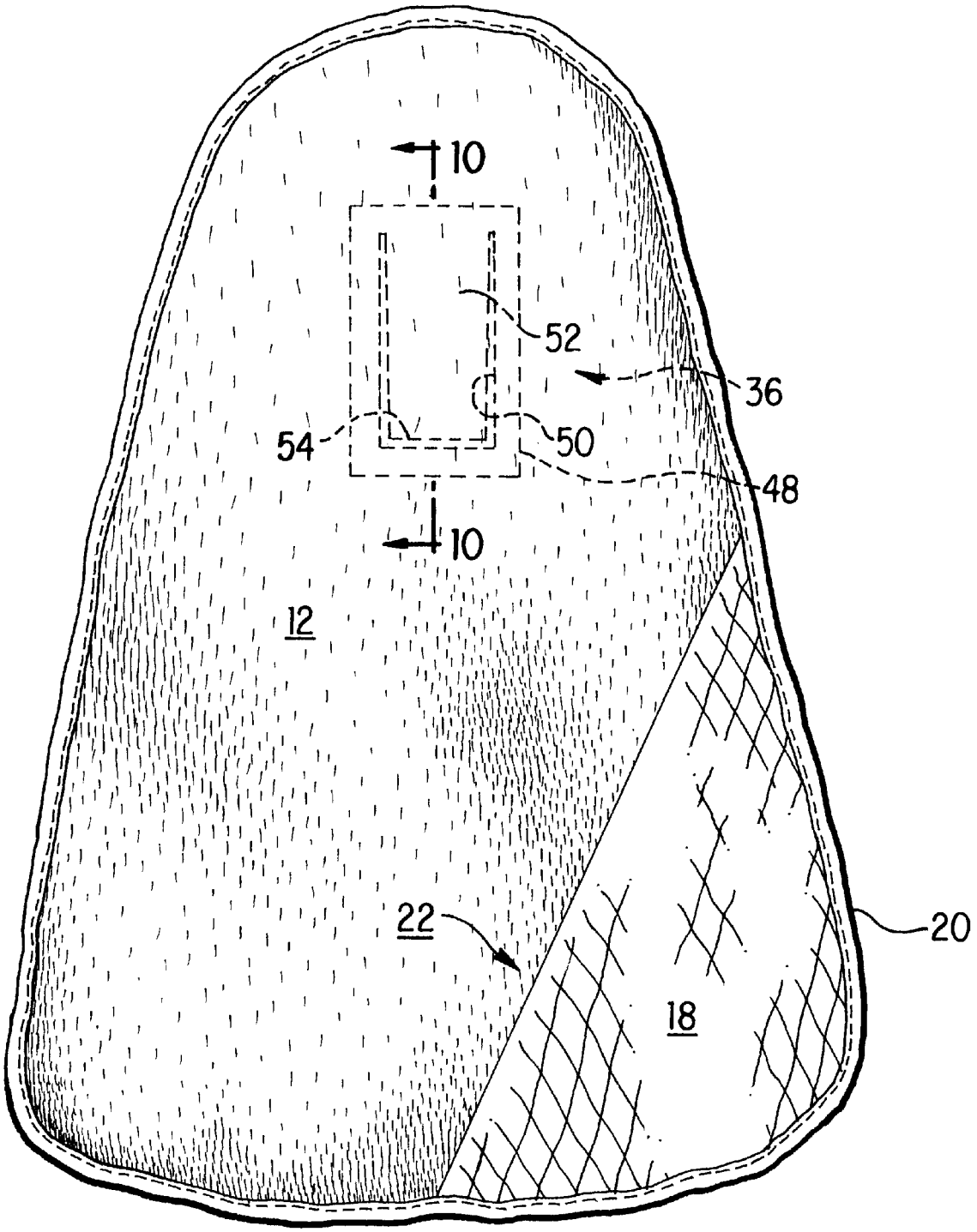
FIG. 2 is a plan view of a second embodiment of the invention.

Referring to FIG. 2, another embodiment of the invention provides a third piece 18 of material mounted on the first piece 10. The material of the third piece 18 is selected from any material presenting a rough surface texture. Prefera bly, the material is a nylon mesh fabric or netting.

The third piece 18 may be mounted on the first piece 12 along the entire back surface area (not shown) of the third piece 18. Preferably, the third piece 18 and first piece 12 define a pocket 22, the closed edges of which corresponding to the seam 20 between the respective peripheral edges of the first piece 12 and third piece 18.

Figure 3:
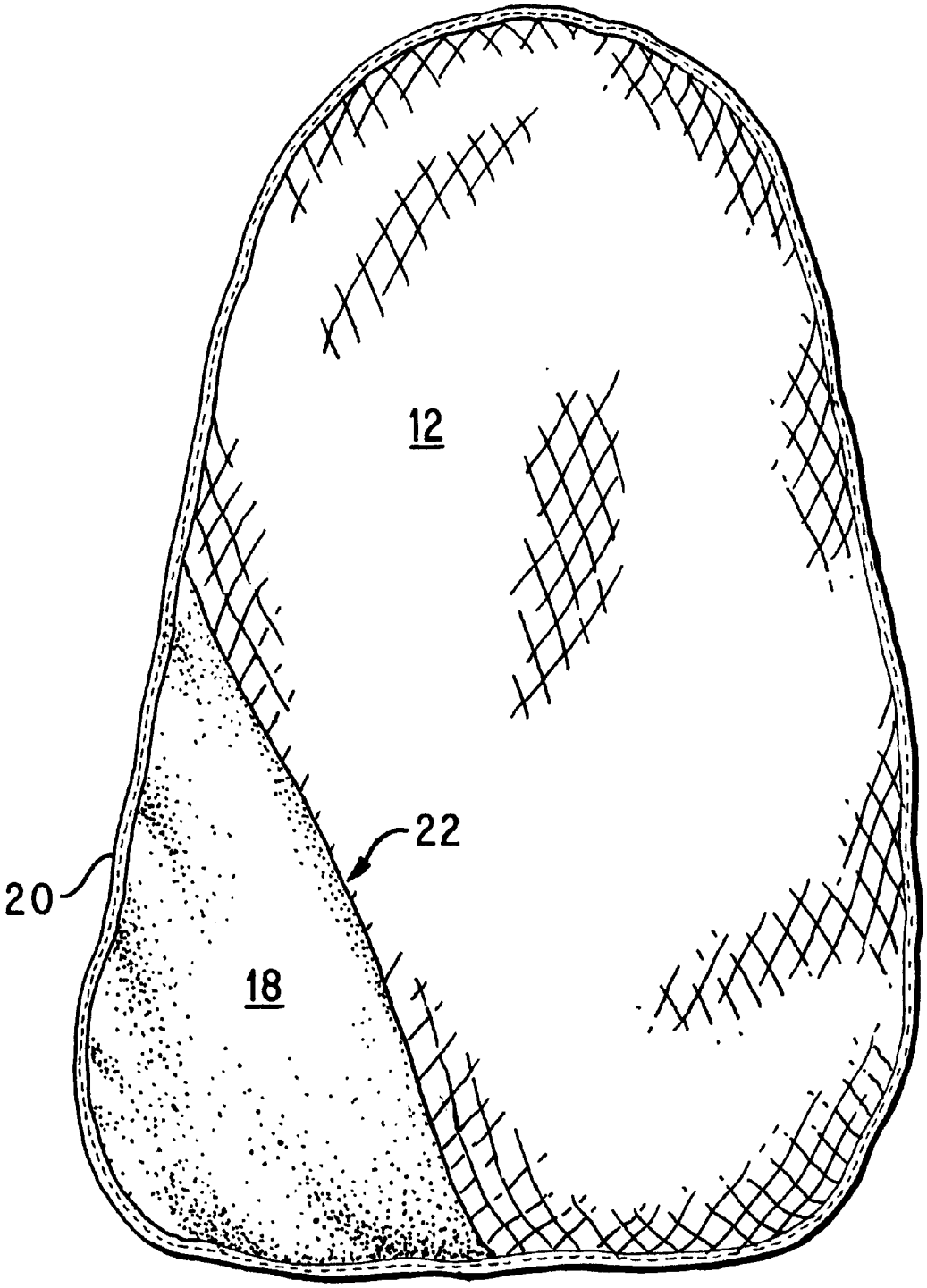
FIG. 3 is a plan view of a third embodiment of the invention.

Referring to FIG. 3, the embodiment as shown in FIG. 2 may be inverted. In this embodiment, the first piece 12 is selected from rough-textured material, such as nylon mesh. The third piece 28 is selected from nappy or felt-like material, such as brushed acrylic pile or polypropylene knit.

Figure 4:
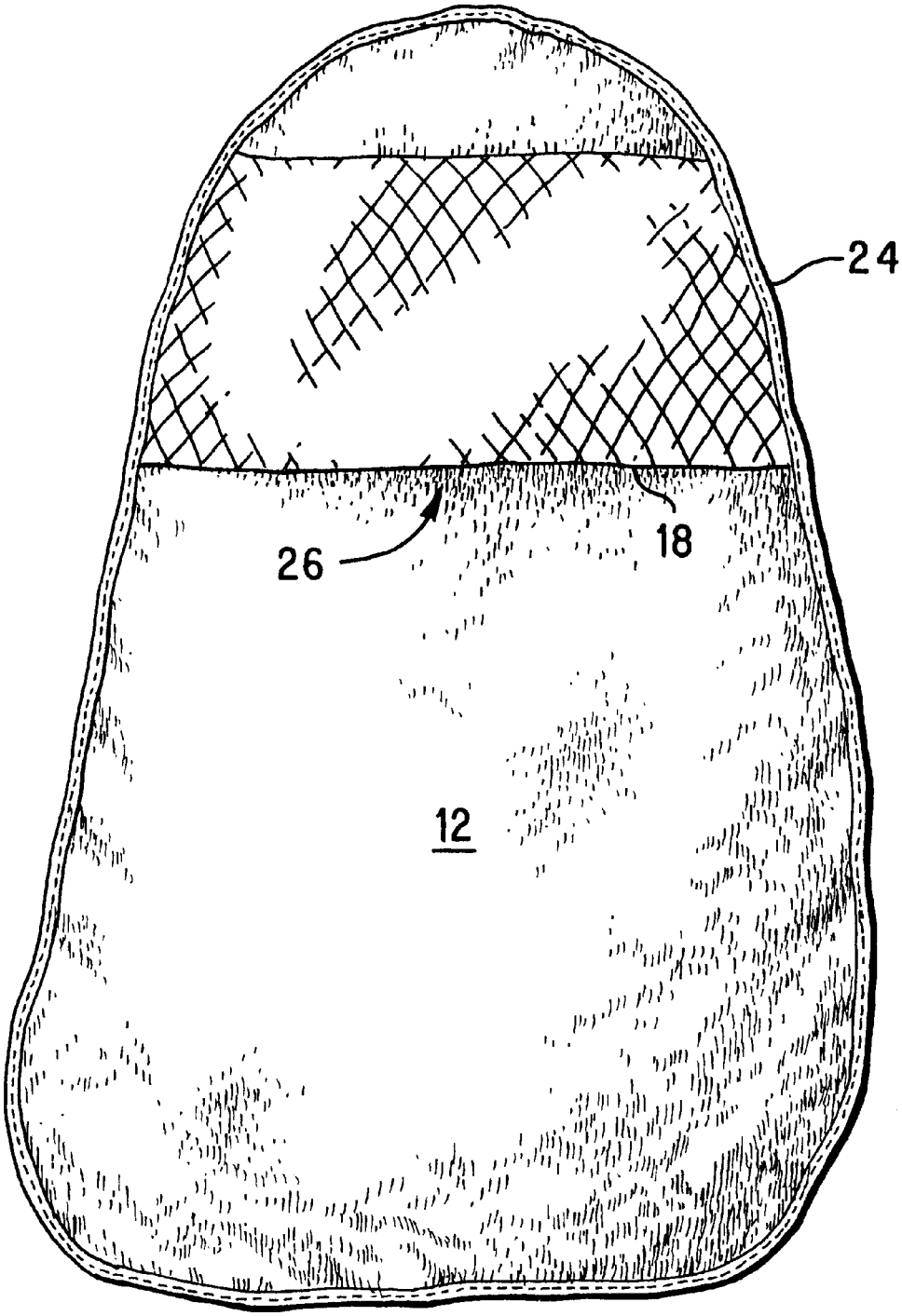
FIG. 4 is a plan view of a fourth embodiment of the invention.

Referring to FIG. 4, another embodiment of the invention is shown. The third piece 18, having a generally trapezoidal shape, is mounted on the first piece in much the same fashion as described above for the embodiments shown in FIGS. 2 and 3. Again, the third piece may be bonded about the entire back surface (not shown). Preferably, the third piece 18 is connected to the first piece 12 only at the union 24 at the peripheral edges of the first piece 12 and third piece 18, as described above, the first piece 12, second piece and seam 24 defining a pocket 26.

Figure 5:
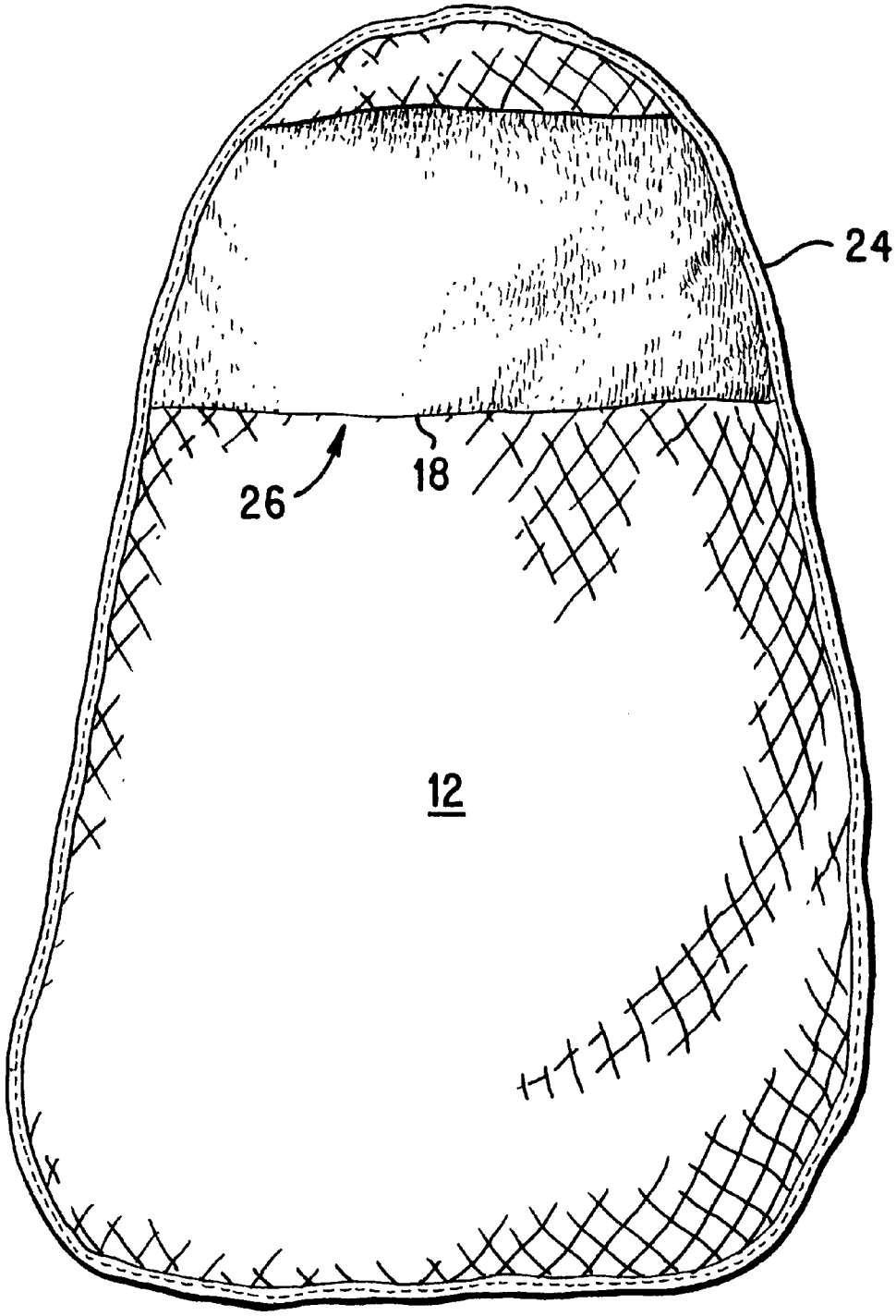
FIG. 5 is a plan view of a fifth embodiment of the invention.

Referring to FIG. 5, another embodiment of the invention provides for the inverse of that shown in FIG. 4. The first piece 12 is made from a mesh material. The third piece 18 is made from a nappy or felt-like material.

Figure 6:
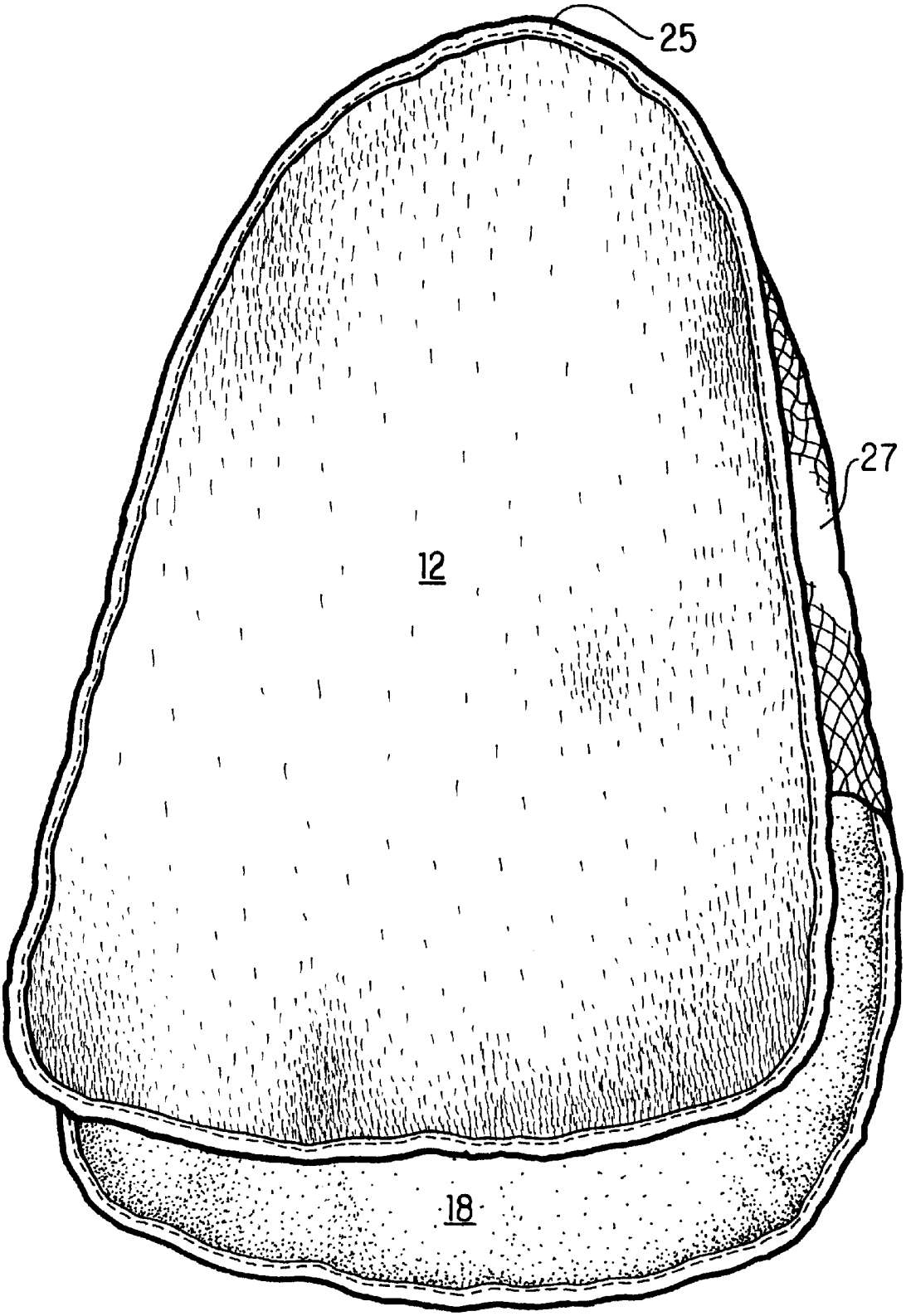
FIG. 6 is a plan view of a sixth embodiment of the invention.
Figure 7:
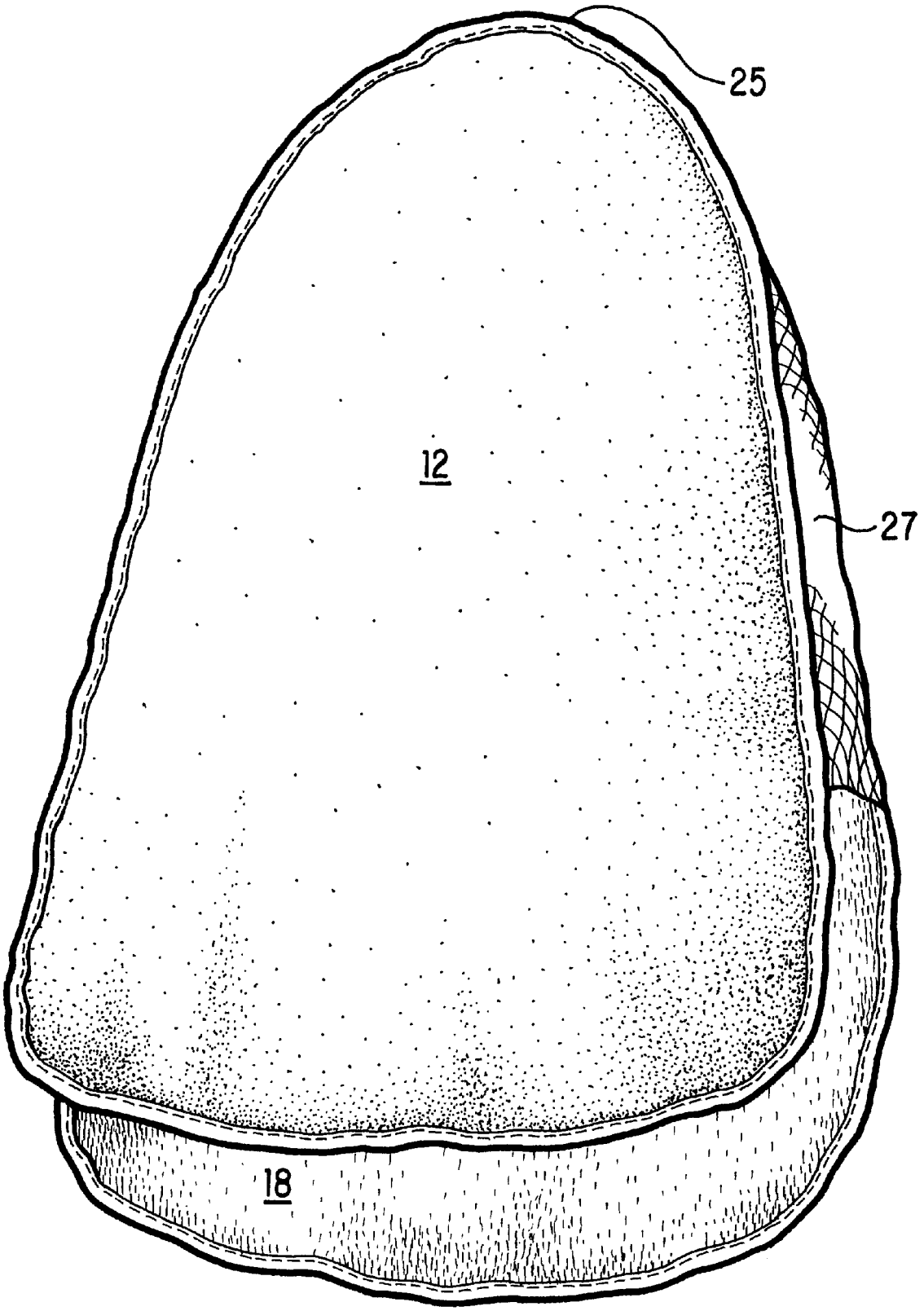
FIG. 7 is a plan view of a seventh embodiment of the invention.

Referring to FIG. 6 and FIG. 7, another embodiment of the invention provides a larger internal pocket configuration. Than provided by the previous embodiments. This embodiment includes a first piece 12 and a second piece 18. The first piece 12 and second piece 18 are stitched only along the upper peripheral edges 25 of each piece, respectively. Side pieces 27 connect the upper peripheral edges 25 of the first piece 12 and second piece 18. Preferably, the first piece 12, second piece 18 and side pieces 27 are formed from mesh material, as described above. An outer layer of material, such as the nappy or felt-like material described above, is mounted on or wraps over the mesh skeleton. In FIG. 6, the mesh material of the first piece 12 is exposed for instructive purposes primarily. However, the invention is not limited to wrapping all or any of the mesh pieces, rather, any select number may be wrapped. The embodiment shown in FIG. 6 provides a pocket into which a golf club or other article may be inserted for cleaning or polishing.

Figure 8:
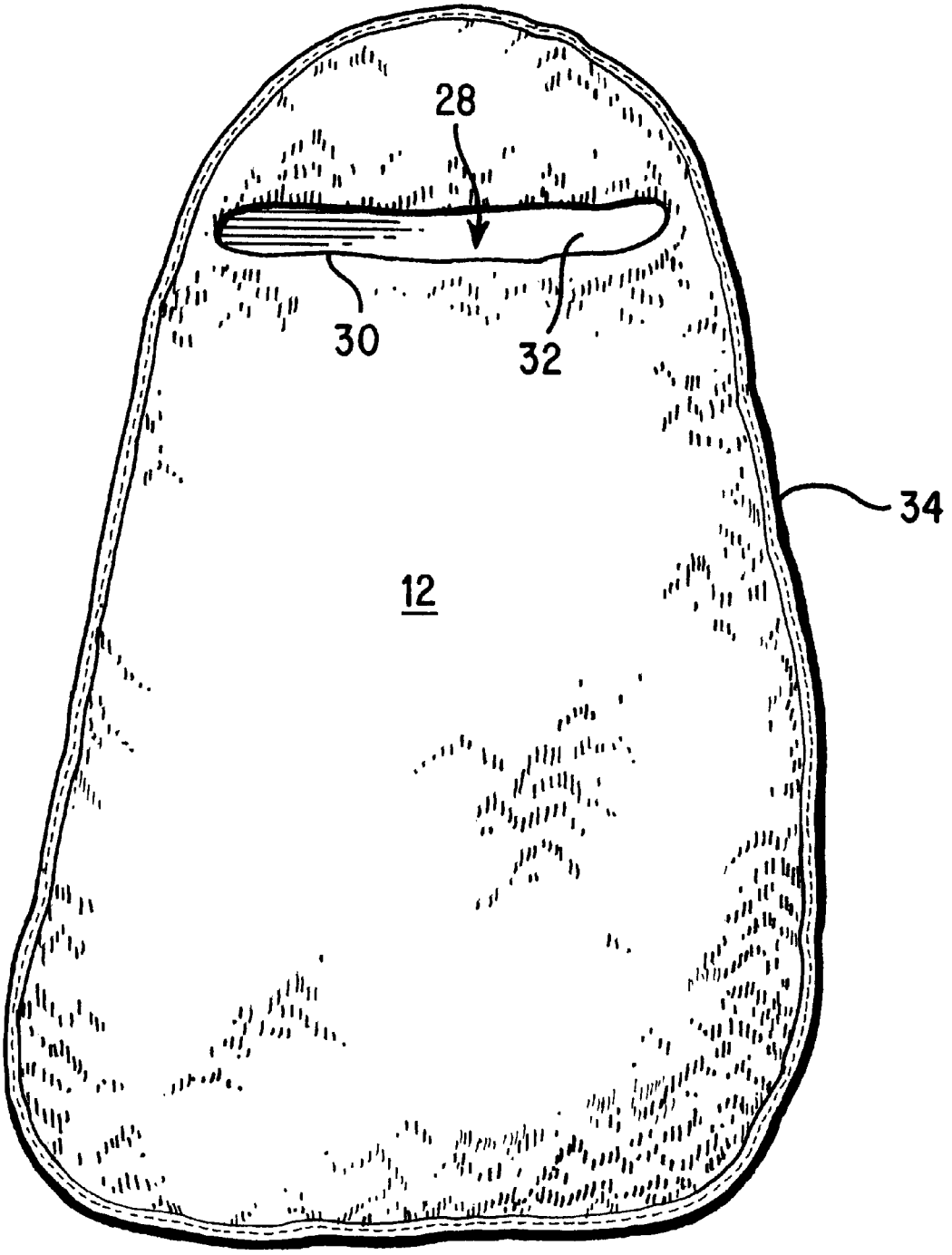
FIG. 8 is a plan view of an eighth embodiment of the invention.

Referring to FIG. 8, another embodiment of the invention is shown having an internal pocket 28. The first piece 12 is shown having an elongated slot 30 therethrough. As described above, the second piece 32 is mounted on the first piece 12 only along their respective peripheral edges. The inner surfaces within the peripheral edges 34 of the first piece 12 and second piece 32 are not bonded, rather move freely with respect to each other and define a variable volume. A slot 30 provides access to this volume.

Figure 9:
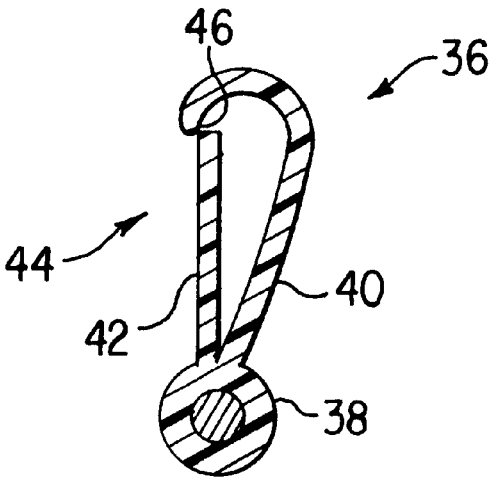
FIG. 9 is a cross-sectional detail view, drawn along line 9—9 in FIG. 1, of attachment means employed in the invention.

Referring to FIG. 1 and FIG. 9, the invention includes fastening means 36 for attaching the device to a target element, such as a golf bag or belt. One embodiment of the fastening means 36 includes a snap clasp 38. The snap clasp 38 has a rigid hook 40 for receiving a ring or like structure of a target element. A non-resilient tang 42 extends across the mouth 44 of the hook 40 and abuts the inner lip 46 thereof. The target element is urged against the tang 42, which bends, providing entry into the mouth 44 of the hook 40. The tang 42 retains the target element within the mouth 44.

Figure 10:
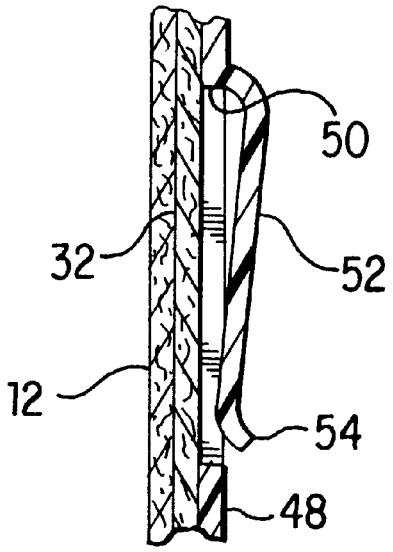
FIG. 10 is a cross-sectional detail view, drawn along line 10—10 in FIG. 2, of another embodiment of the attachment means employed in the invention.

Referring to FIG. 2 and FIG. 10, a second embodiment of the fastening means 36 is shown. This embodiment is better suited for attachment of the device to a belt or similar articles. The second embodiment includes a plate 48 mounted on the second piece 32. The plate 48 has an aperture 50. A non-resilient clasp 52 is received in the aperture 50. The target element may be received between the distal end 54 of the clasp 52 and plate 48 which cooperatively squeeze and retain the target element.

The present invention is not intended to be limited to the embodiments described above, but to encompass all embodiments and equivalents thereof within the scope of the following claims.

I claim:

1. A sports towel comprising:

a first piece of material having a first exterior surface with and a second exterior surface;

said first exterior surface having a pile texture having a first abrasiveness, said second exterior surface having a felt texture having a second abrasiveness, the first abrasiveness being different than the second abrasiveness.

2. A sports towel as recited in claim 1, further comprising a second piece of material mounted on said first surface of said first piece of material.

3. A sports towel as recited in claim 2, said first piece of material and said second piece of material defining a pocket.

4. A sports towel as recited in claim 2, wherein said second piece of material is constructed from material selected from the group consisting of brushed acrylic pile, polypropylene knit, nylon mesh, polyester mesh and combinations thereof.

5. A sports towel as recited in claim 2, further comprising a first side piece interposed between said first piece of material and said second piece of material.

6. A sports towel as recited in claim 5, further comprising a second side piece interposed between said first piece of material and said second piece of material.

7. A sports towel as recited in claim 1, further comprising means for fastening said sports towel to a target element.

8. A sports towel as recited in claim 1, wherein said first piece of material is constructed from material selected from the group consisting of brushed acrylic pile, polypropylene knit, nylon mesh, polyester mesh and combinations thereof.

9. A sports towel comprising:

a first piece of material having a first surface with a pile texture having a first abrasiveness; and a second piece of material, having a first side with a felt texture having a second abrasiveness, the second abrasiveness being different than the first abrasiveness, said second piece of material being mounted on said first piece of material, forming an assembly having an assembly surface.

10. A sports towel as recited in claim 9, said first piece of material and said second piece of material defining a first pocket.

11. A sports towel as recited in claim 9, further comprising a third piece of material mounted on said assembly surface of said assembly.

12. A sports towel as recited in claim 11, said third piece of material and said assembly defining a second pocket.

13. A sports towel as recited in claim 11, wherein said third piece of material is constructed from material selected from the group consisting of brushed acrylic pile, polypropylene knit, nylon mesh, polyester mesh and combinations thereof.

14. A sports towel as recited in claim 9, wherein said first piece of material and said second piece of material are constructed from material selected from the group consisting of brushed acrylic pile, polypropylene knit, nylon mesh, polyester mesh and combinations thereof.

15. A sports towel as recited in claim 9, further comprising means for fastening said sports towel to a target element.

16. A sports towel as recited in claim 9, further comprising a first side piece interposed between said first piece of material and said second piece of material.

17. A sports towel as recited in claim 16, further comprising a second side piece interposed between said first piece of material and said second piece of material.

* * * * *